United States Patent [19]

Clark

[11] Patent Number: 4,638,997

[45] Date of Patent: Jan. 27, 1987

[54] COMBINATION TOY AND GAME

[75] Inventor: Gary E. Clark, Sikeston, Mo.

[73] Assignees: G. W. Gilmore, Sikeston; R. G. Heywood, St. Louis, both of Mo. ; part interest to each

[21] Appl. No.: 782,937

[22] Filed: Oct. 2, 1985

Related U.S. Application Data

[63] Continuation-in-part of Ser. No. 596,040, Apr. 2, 1984, abandoned.

[51] Int. Cl.[4] ..... A63F 9/00

[52] U.S. Cl. ..... 273/1 GD; 273/1 GG; 273/336; 273/425; 434/247; 434/258; 446/425

[58] Field of Search ..... 273/1 G, 1 GG, 1 GD, 273/1 M, 425, 424, 336–339; 446/425; 434/258–260, 247

[56] References Cited

U.S. PATENT DOCUMENTS

| | | | |
|---|---|---|---|
| 413,448 | 10/1889 | Hofer | 273/425 X |
| 606,744 | 7/1898 | St. John | 273/1 GD UX |
| 2,146,457 | 2/1939 | Vernon | 273/336 X |
| 2,454,478 | 11/1948 | Roberts | 273/1 GG X |
| 3,578,319 | 5/1971 | Kohner et al. | 273/1 GG |
| 3,583,702 | 6/1971 | Glass et al. | 273/1 GD |
| 3,721,440 | 3/1973 | Burns | 273/1 GG |
| 3,874,661 | 4/1975 | Mc Bain | 273/1 G |
| 4,111,416 | 9/1978 | De Ment, Jr. | 434/258 X |

FOREIGN PATENT DOCUMENTS

| | | | |
|---|---|---|---|
| 379385 | 6/1922 | Fed. Rep. of Germany | 273/336 |
| 609996 | 5/1926 | France | 273/425 |
| 159971 | 2/1933 | Switzerland | 273/336 |

*Primary Examiner*—Paul E. Shapiro
*Attorney, Agent, or Firm*—Richard G. Heywood

[57] ABSTRACT

A combination toy and game apparatus for two or more players having two sets of distinguishable metal scoring pieces with scoring indicia thereon, first and second spaced stations for holding said scoring pieces, and magnetic means for transferring said scoring pieces from said first station to said second station in which the magnetic means is adapted to be manually movable in vertical and horizontal planes to selectively and sequentially transfer the scoring pieces.

13 Claims, 7 Drawing Figures

COMBINATION TOY AND GAME

This application is a continuation-in-part of copending U.S. application Ser. No. 596,040 filed Apr. 2,1984, now abandoned.

BACKGROUND AND SUMMARY OF THE INVENTION

The present invention relates generally to games and toys, and more particularly to a combination magnetic toy and game apparatus having transferable scoring pieces.

The purpose of the invention is to provide a novel toy and game combination that utilizes skills of dexterity and increases numerical counting ability.

An object of the invention is to provide a cranetype toy having magnetic means movable in two planes for playing with magnetically attractable objects, and particularly transferring game playing pieces from a first position to a scoring position.

Another object is to provide a game apparatus having distinguishable sets of scoring disc members that are magnetically manipulable to a scoring position with or without the use of "time" as a skill factor.

Another object is to provide a combination toy and game apparatus that is attractive, sturdy, inexpensive and simple to play with and operate.

These and still other objects and advantages will become readily apparent hereinafter.

DESCRIPTION OF THE DRAWINGS

The invention is also embodied in features and combinations of parts hereinafter described and claimed. In the accompanying drawings wherein like numerals refer to like parts wherever they occur:

DESCRIPTION OF THE PREFERRED EMBODIMENTS

Figures 1, 2, 3:
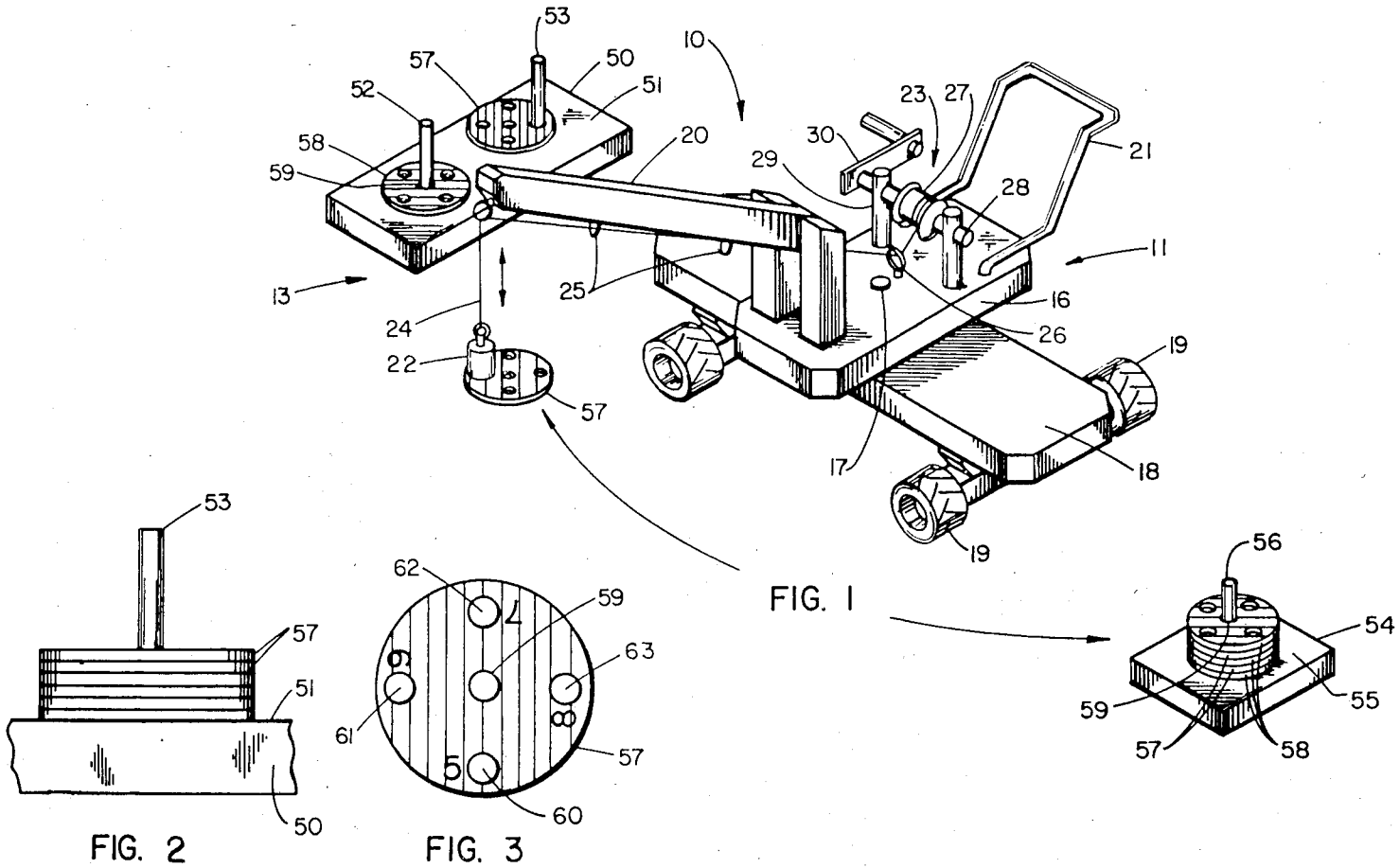
FIG. 1 is a perspective view of a combination toy and game apparatus embodying the present invention and illustrating a transitional move in the play of the game.
FIG. 2 is a fragmentary side elevation view of a stack of scoring markers shown on their starting peg.
FIG. 3 is a plan view of one form of a scoring marker used in the game device.

Referring now to the drawings, a combination toy and game apparatus 10 is illustrated as a presently preferred form of the invention and includes a combination toy comprising a crane-type unit 11 (FIGS. 1, 5 and 6) and a trailer unit 12 (FIG. 7) and a game apparatus 13 that is best played by two persons although adapted to be played by teams of partners taking alternating turns.

The crane unit 11 has a base frame or bed 16 centrally pivotally mounted for complete swinging movement on a suitable vertical axis 17 journalled in a mobile frame or chassis 18 mounted on wheels 19. The crane unit 11 has an arm or boom member 20 secured at one end of the base frame 16 and extending upwardly and projecting outwardly beyond the periphery of the carrying base member 18, and a U-shaped handle member 21 is secured to the other end of the base frame 16 to effect the horizontal pivotal swinging movement of the crane unit 11 on the mobile chassis 18. The crane unit 11 includes a magnetic device 22 operated by a winch device 23 centrally mounted on the base frame 16 between the crane 20 and handle 21. The magnetic device 22 is tethered by a flexible line 24 through eyelet guides 25 secured to the boom member 20 and eyelet 26 on the base frame 16, and the line 24 is wound upon a winching spool 27 mounted on a spindle 28 journalled in vertical posts 29 and a winching handle or crank 30 is provided on one end of the spindle 28 to rotate or turn the spool 27 and thereby wind and unwind the line 24 to vertically raise or lower the magnetic device 22. It will be readily apparent that the entire body of crane unit 11 can be manipulated to pivot on pin 17 by using one hand while the crank handle 30 can be turned with the other hand to raise or lower the magnet 22. This action develops coordination and skill, and is the basis for playing the game of this invention as will be described presently.

Figure 7:
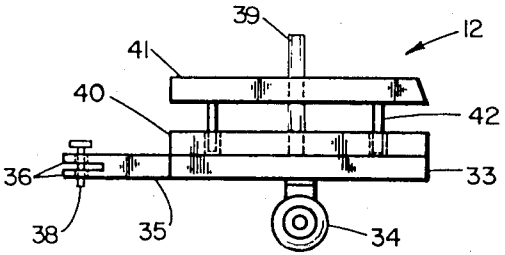
FIG. 7 is a side elevational view of another part of the combination toy.

As shown in FIG. 7, the trailer unit 12 comprises a base frame or carriage 33 mounted on dual wheels 34 and has a trailer hitch 35 with a split tongue 36 removably connectable to a complementary hitch 37 extending from the rear of crane unit base frame 18 and secured thereto by a vertical pin 38. A vertical peg 39 is centrally located in the bed 33 for use in connection with the game apparatus, as will appear, and the bed frame 33 is also provided with lower side and end boards 40 and spaced rails 41 which may be secured in fixed position or removably mounted on posts 42. It should be noted that when the trailer 12 is hitched to the crane unit 11 and the boom member 20 is swung around rearwardly, the magnetic device 22 is substantially vertically aligned with the post 39 on the trailer bed. This is a feature of the toy and of the game about to be described. It should be understood, however, that the crane (20) and magnetic lift device (22) comprises only a presently preferred form of the combination toy that interfaces with the game apparatus, and that other manual and/or magnetic or electromagnetic devices can be used in playing the game apparatus.

With reference to FIG. 1, the game apparatus 13 utilizes a starting block or primary station 50 having flat upper surface 51 and spaced pegs 52 and 53 extending therefrom, and a scoring block or secondary or finishing station 54 having an upper surface 55 and at least one peg 56 extending therefrom. Two sets of separate or discrete scoring markers 57 and 58 are provided having distinguishable features, such as being different colors. As shown, the disc members 57 are red and the disc members 58 are blue. It will also be understood that although the disc members are shown to be circular, they may be of different geometric shapes, such as square, triangular or the like. Thus, either color or shape or both may constitute distinguishable features. Each disc 57 and 58 has a central opening 59, and is provided with scoring indicia. As shown in FIG. 3 for illustration purposes, the disc members may have a series of different perforations 60, 61, 62, 63, each of which represents a different value in scoring such as "5", "6", "7" and "8", and the central opening 59 may have another value, such as "10". In the play of the game, the sets of differently distinguishable discs 57 and 58 may be stacked on their respective pegs 53, 52 of the starting station 50 and are transferred to the finish or scoring station 54 by game opponents taking alternate turns in manipulating the crane boom 20 and magnetic device 22 or the like to sequentially restack each disc on one of its openings and, with skill, the hole having the highest scoring indicia will be placed on the peg. Thus, in this form of the game the discs 57 and 58 are stacked in columns on separate starting pegs aligned on their central openings 59 and are then moved and restacked alternately on the finishing peg 56 of scoring station 54. In this form the trailer peg 39 may be used as a scoring station and the game then ends with all of the toy pieces being assembled together except for the starting block. In one variation, the game can be played in reverse, by moving discs alternately from the block 54 to the posts 52 and 53 of the block 50, and it will be noted that the disc 57 is shown placed on peg 53 in FIG. 1 on one of the outer scoring holes by way of illustration. Obviously, the scoring is carried out by tabulating the marker values of each player, the winner being the one with the highest score. The game may also be played with a time limit so that skill in operating the toy becomes a major factor.

Figure 5:
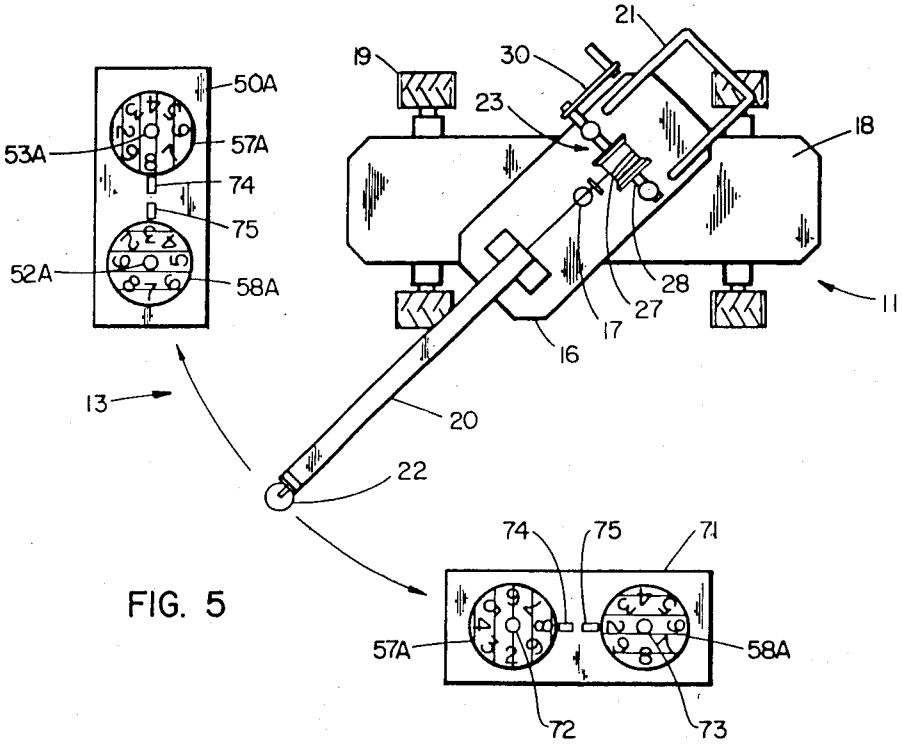
FIG. 5 is a plan view of the combination toy and game apparatus of FIG. 1.
Figure 4:
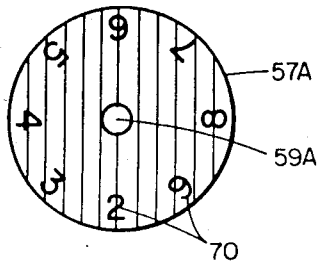
FIG. 4 is a plan view of another form of scoring marker used in the game device.
Figure 6:
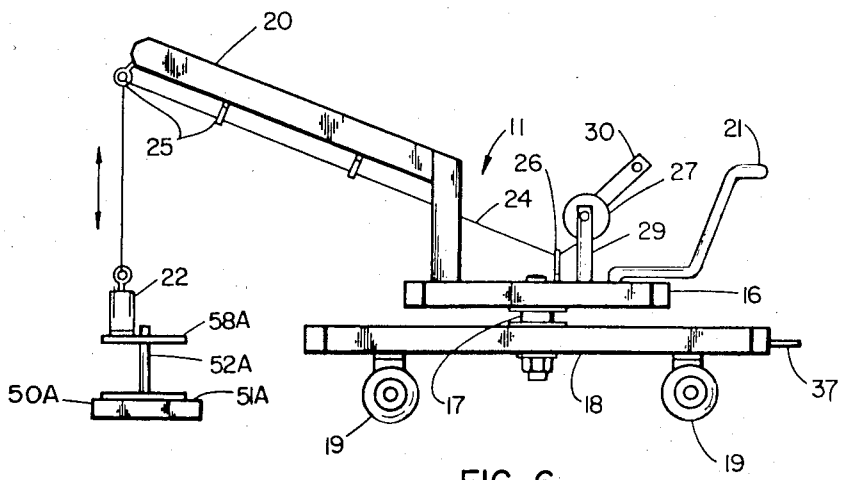
FIG. 6 is a side elevational view showing one part of the combination toy in one stage of the play of the game.

Referring particularly to FIGS. 4–6, another variation of the game uses a disc member 57A with central opening 59A and having the scoring indicia 70 printed about the periphery of the disc in lieu of separate scoring apertures. A dual starting station 50A with pegs 52A and 53A may again be used and a dual finishing or scoring station 71 with dual pegs 72 and 73 may also be provided. Thus, the starting station 50A and scoring block 71 provide each player with separate but equal transfer paths from start to finish since the arc from peg 53A to peg 72 will be the same as the arc from peg 52A to peg 73. These two blocks are also provided with scoring markers or index lines 74 (for peg 53A and/or peg 72) and 75 (for peg 52A and/or peg 73), and preferably these markers are in color to match the respective colors of discs 57A and 58A. Thus, the scoring marker 74 on the scoring block 71 will be red and the red discs 57A transferred to peg 72 will be scored by counting the number or peripheral scoring indicia 70 that is aligned with the marker index line 74.

From the foregoing, it will be understood that the combination toy and game provides an interesting and educational apparatus for improving skills in dexterity and numerical counting. The game can be played by two players, each having a differently colored and/or shaped set of metal disc members; or the game may be played by any number of players on a team basis taking alternate turns.

What is claimed is:

1. A combination toy and game apparatus for two players, comprising two sets of distinguishable, magnetic metal scoring pieces and each set thereof comprising a multiplicity of relatively flat and stackable discrete members having scoring indicia thereon, first and second spaced stations for holding said two sets of discrete scoring pieces, said first station being a starting station and including a pair of separate and spaced apart vertical pegs, each of which holds all of the scoring pieces in one of said sets in a vertically stacked starting condition, said second station being a scoring station and including at least one vertical peg adapted to receive all of the scoring pieces of at least one of said sets in a stacked condition thereon, all of said discrete scoring pieces in both sets having at least one opening for the stacking of said scoring pieces on said vertical pegs, and magnetic toy means for individually transferring said discrete scoring pieces sequentially from said spaced pegs of said starting station to said second station.

2. The combination toy and game apparatus according to claim 1, in which said one opening in each of said scoring pieces is centrally located, said scoring indicia on said scoring pieces comprises a plurality of different numbers, and said second station including means for identifying the scoring indicia.

3. The combination toy and game apparatus according to claim 2, in which said scoring indicia on each of said disc members comprises additional openings arranged outwardly of about said central opening, and said scoring indicia comprising a different identifying numerical value for said central opening and each of said additional openings.

4. The combination toy and game apparatus according to claim 2, in which said scoring indicia comprises a series of numbers imprinted in spaced relation on the periphery of said scoring pieces, and said means for determining the scored value comprises indicator markers on said scoring station radially positioned from said vertical peg.

5. The combination toy and game apparatus according to claim 1, in which said magnetic toy means comprises crane means having a boom member adapted to be moved in a prescribed lateral horizontal arc between said starting and scoring stations, and magnet means adapted for selective vertical movement relative to said boom member and the vertical pegs of said starting and scoring stations whereby said scoring pieces are individually engagable by said magnet means and movable thereby in said vertical and horizontal paths of transfer from said starting station to said scoring station.

6. The combination toy and game apparatus according to claim 5, in which said boom member is mounted on a frame member pivotally mounted on a mobile main chassis for horizontal swinging movement, and trailer means releasably attached to said mobile chassis and including a central vertical peg adapted to function as said second station.

7. The combination toy and game apparatus according to claim 6, in which said boom member is mounted on said frame member and projects outwardly over said mobile chassis, and handle means on said frame member for said manual manipulation of said frame and boom members to swing horizontally in said lateral arc.

8. The combination toy and game apparatus according to claim 6, in which said magnet means is tethered to depend from the outer end of said boom member, and winching means for manually raising and lowering said magnet means relative to said boom member.

9. A combination toy and game apparatus for two players, comprising two sets of distinguishable, magnetic metal scoring pieces and each set thereof comprising a multiplicity of relatively flat and stackable discrete members having scoring indicia thereon, first and second spaced stations for holding said two sets of discrete scoring pieces, said first station being a starting station and including a pair of separate and spaced apart vertical pegs, each of which holds all of the scoring pieces in one of said sets in a vertically stacked starting condition, said second station being a scoring station and including at least one vertical peg adapted to receive all of the scoring pieces of at least one of said sets in a stacked condition thereon, all of said discrete scoring pieces in both sets having a central opening for the stacking of said scoring pieces on said vertical pegs, and magnetic toy means for individually transferring said discrete scoring pieces sequentially from said spaced pegs of said starting station to said second station, said magnetic toy means comprising crane means having a boom member adapted to be moved in a prescribed lateral horizontal arc between said starting and scoring stations, and magnet means adapted for selective vertical movement relative to said boom member and the vertical pegs of said starting and scoring stations whereby said scoring pieces are individually engagable by said magnet means and movable thereby in said vertical and horizontal paths of transfer from said starting station to said scoring station.

10. The combination toy and game apparatus according to claim 9, wherein said crane is mounted on a mobile chassis, and a mobile trailer releasably attached to said mobile chassis and including said second station for receiving scoring pieces carried by said magnet means.

11. The combination toy and game apparatus according to claim 9, in which said scoring indicia on said scoring pieces comprises a plurality of different numbers, and said second station includes means for identifying the scoring number.

12. The combination toy and game apparatus according to claim 11, in which said scoring indicia on each of said disc members comprises additional openings arranged in an outer circle about said central opening, and said scoring indicia comprising a different identifying numerical value for said central opening and each of said additional openings.

13. The combination toy and game apparatus according to claim 11, in which said scoring indicia comprises a series of numbers imprinted in spaced relation on the periphery of said scoring pieces, and said means for determining the scored value comprises indicator markers on said scoring station radially positioned from said vertical peg.

* * * * *